US005119109A

United States Patent [19]

Robertson

[11] Patent Number: 5,119,109

[45] Date of Patent: Jun. 2, 1992

[54] METHOD AND APPARATUS FOR MARKING THE INSIDE SURFACE OF PIPE

[75] Inventor: John A. Robertson, Chilicothe, Ohio

[73] Assignee: Telesis Controls Corporation, Chillicothe, Ohio

[21] Appl. No.: 539,790

[22] Filed: Jun. 18, 1990

[51] Int. Cl.[5] ..... G01D 15/18; B41F 17/00

[52] U.S. Cl. ..... 346/1.1; 346/33 R; 346/76; 101/35

[58] Field of Search ..... 346/1.1, 33 R, 75, 140; 400/126; 101/35; 118/317; 901/43

[56] References Cited

U.S. PATENT DOCUMENTS

| | | | |
|---|---|---|---|
| 4,304,179 | 12/1981 | Katou et al. | 101/34 |
| 4,557,191 | 12/1985 | Speicher | 101/35 |
| 4,667,594 | 5/1987 | Eddy | 101/35 |
| 4,682,182 | 7/1987 | Oyama et al. | 346/1.1 |
| 4,985,715 | 1/1991 | Cyphert et al. | 346/140 R |

*Primary Examiner*—Benjamin R. Fuller
*Assistant Examiner*—Alrick Bobb
*Attorney, Agent, or Firm*—Mueller and Smith

[57] ABSTRACT

Method, apparatus, and system are described wherein dot matrix characters are formed by an array of ink spray nozzles within a marker head assembly upon the inside surface of a pipe or other curved surface. The marker head is moved by a traversing arrangement including a carriage in a manner wherein full character pixels are formed during movement of the marker head along locii parallel with the longitudinal axis of the pipe being marked. This achieves full messages marking with a minimized number of required marker head movements along the inside surface. An indexing mechanism engages the outer surface of the pipe to index it from one marking locus to a next. A translational mechanism moves the marker head traversing mechanism from off-line to on-line positions at the production path during the course of operation of the system.

26 Claims, 10 Drawing Sheets

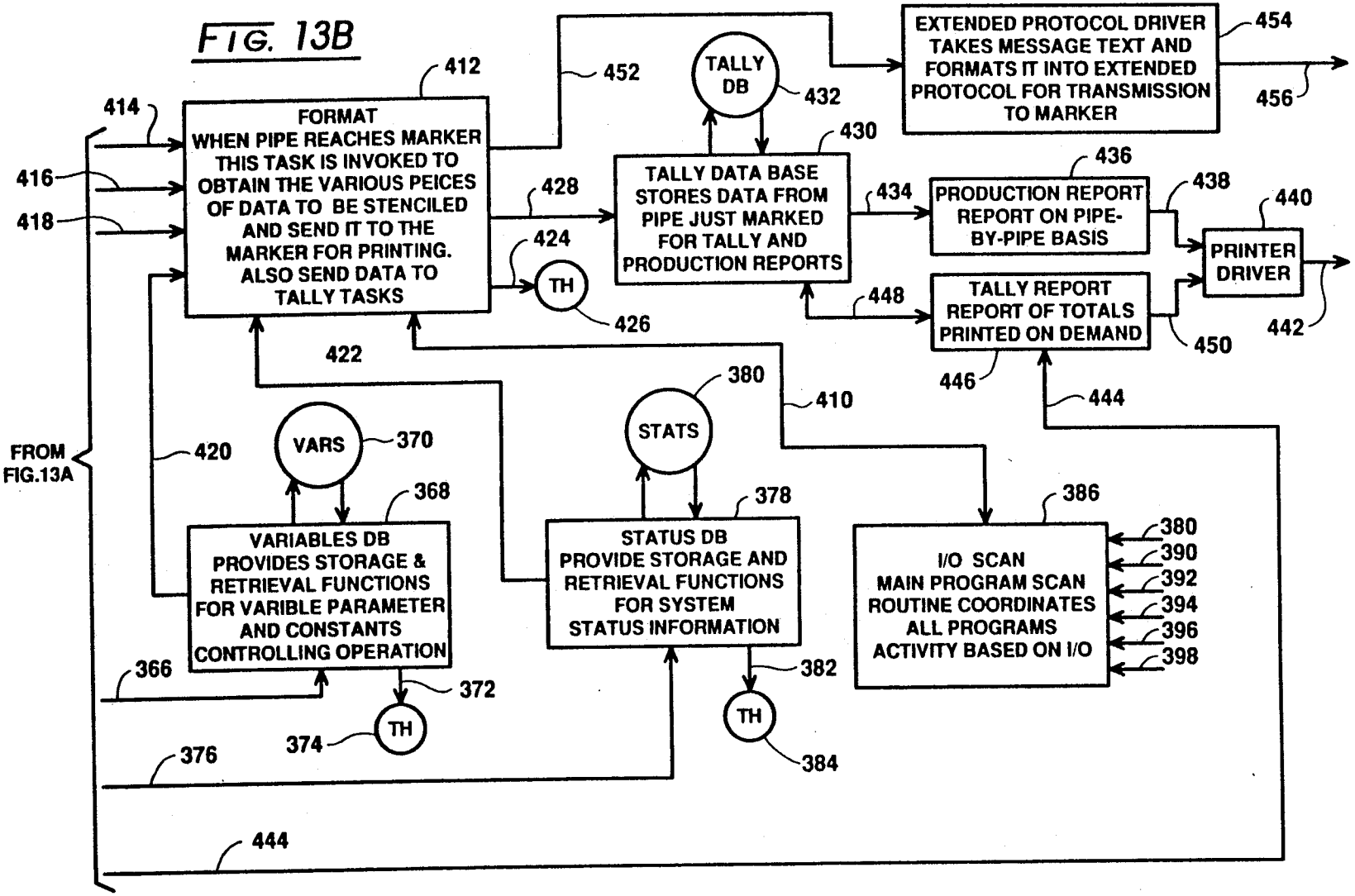
FIG. 13B
FORMAT
WHEN PIPE REACHES MARKER THIS TASK IS INVOKED TO OBTAIN THE VARIOUS PEICES OF DATA TO BE STENCILED AND SEND IT TO THE MARKER FOR PRINTING. ALSO SEND DATA TO TALLY TASKS
TALLY DB
TALLY DATA BASE STORES DATA FROM PIPE JUST MARKED FOR TALLY AND PRODUCTION REPORTS
EXTENDED PROTOCOL DRIVER TAKES MESSAGE TEXT AND FORMATS IT INTO EXTENDED PROTOCOL FOR TRANSMISSION TO MARKER
PRODUCTION REPORT REPORT ON PIPE-BY-PIPE BASIS
PRINTER DRIVER
TALLY REPORT REPORT OF TOTALS PRINTED ON DEMAND
TH
STATS
STATUS DB PROVIDE STORAGE AND RETRIEVAL FUNCTIONS FOR SYSTEM STATUS INFORMATION
VARS
VARIABLES DB PROVIDES STORAGE & RETRIEVAL FUNCTIONS FOR VARIBLE PARAMETER AND CONSTANTS CONTROLLING OPERATION
I/O SCAN MAIN PROGRAM SCAN ROUTINE COORDINATES ALL PROGRAMS ACTIVITY BASED ON I/O
FROM FIG.13A
412
414
416
418
420
422
424
426
428
430
432
434
436
438
440
442
444
446
448
450
452
454
456
410
366
368
370
372
374
376
378
380
382
384
386
380
390
392
394
396
398

METHOD AND APPARATUS FOR MARKING THE INSIDE SURFACE OF PIPE

BACKGROUND OF THE INVENTION

Larger pipe products are produced under a variety of industrial trade standards or regulations, as well as end user design specifications. As a consequence, a considerable amount of data concerning manufacturing history and the like are associated with each production run of such products.

As part of an industry effort to maintain quality standards, as well as to assure proper usage in the field, typically, identifying data are applied to each length of pipe or tube at the time of production. Because the outside surfaces of pipe products often are coated or wrapped, those surfaces often are not available for such marking. Accordingly, it has been found necessary to position such data on the circular inside surfaces of pipe product near one open end. Typically the marking procedure has been carried out manually by personnel utilizing a hand-held paint sprayer in conjunction with a flexible stencil which is positioned over the inside surface. As the amount of marking data has increased, this manual procedure has been found to be cumbersome, time consuming, and prone to human error.

Investigators have considered automated approaches to carrying out such marking, for example utilizing industrial spray marking systems, a marking technology which involves the formation of characters or symbols in dot matrix fashion using discrete dot-like deposits of marker fluid such as marker ink. Conventionally, this marker ink is expressed from select ones of a linear array of nozzles in conjunction with nebulizing air to form dots at the surface to be marked. When these linearly arrayed nozzles are called upon to mark a circularly shaped surface internally within a pipe structure, however, their marking performance has been considered unsatisfactory for a variety of reasons. In this regard, where the nozzle arrays are used according to conventional practice, i.e. moved with respect to the longitudinal axis of the pipe being marked, variations from nozzle-to-nozzle in nozzle-to-marked surface distance results in the formation of unsatisfactory characters. Fabricating the nozzle assembly as a circular array is impractical, inasmuch as the systems are called upon to mark pipe of somewhat widely varying diameters. Additionally, the mechanisms necessarily become unacceptably complex due to radial and axial alignment requirements for the nozzle support mechanisms.

Resort to the use of assemblies carrying character dedicated singular spray marker nozzles which are maneuvered in parallel with the axis of the pipe being marked has been considered. With such approach, one or more character dedicated nozzles are moved by a traversing mechanism along an undulating locus generally parallel with the axis of the pipe being marked. Where fifteen characters formed within a conventional 5×7 dot matrix format are involved for each nozzle, about 90 short, quick moves are required of the traversing mechanism. Thus, where such mechanisms are called upon to mark or create a practical number of characters, the number reciprocal mechanical motions required of the support and drive mechanisms becomes excessive with a resultant unacceptable time-of-marking expenditure. Similarly, where single nozzles are dedicated to form one row of characters oriented transversely to the pipe axis, a very high accuracy is required of the traversing/timing system, in that dot or pixel-to-pixel accuracy must be better than one pixel element (e.g. 0.2 inch) after forming five to seven paths within the pipe. As before, such an approach is slow, inasmuch as one nozzle must form a complete string of characters.

From the foregoing, it may be observed that a marking technique is called for which accommodates a marker unit to the curved surface of the pipe to be marked while remaining capable of providing a plurality of lines of data within the generally limited window of available marking time experienced, for example, in a pipe production facility. This expedited marking procedure further should be carried out without the involvement of complex translational movement defining machinery and associated controls endemic to the procedures and equipment proposed in the past. A comparatively simple, efficient system having enhanced printing speeds is desired for such in-plant marking systems which, additionally, may be integrated into the pipe treatment aspects of production. The latter aspects include, inter alia, automated pipe length measuring stations, weighing stations, and the like.

SUMMARY

The present invention is addressed to apparatus, method, and system for marking characters upon curved surfaces such as those encountered at the interior surface of larger diameter pipes. Characters are formed by an array of marker components such as spray markers. Each such marker is associated with one linear component of a character matrix as the array of markers is moved along locii parallel, for example, to the axis of a pipe, the internal surface of which is to be marked. The result of this procedure is the formation of characters of high image quality and within desirably shortened marking intervals. Relative motion between the marker head carrying an array of marker components and the interior surface to be marked may be carried out by indexably rotating the pipe following the marking interval. Because of the desirably shortened number of movements called upon by the head supporting mechanism, the apparatus required is desirably simple and of reasonable cost. With the system of the invention, substantial data representing pipe length, weight, and the like may be complied for generating message material formatted for message formation.

Another feature of the invention is to provide apparatus for marking dot matrix characters upon the curved surface of a component having a given axis about which the surface is curved which includes a support arrangement for locating the curved surface at a marking station. A marker head having a marker axis and a linear array of marking devices, each selectively actuable to form the dot pixels of a pixel defined character within a predetermined matrix of select dimensional extent is provided and a traversing arrangement supports the marker head at an elevation above the surface to be marked to position the array of marking devices for marking interaction therewith and is drivable for reciprocally moving the marker head along locii substantially parallel with the given axis. An indexing arrangement is actuable to effect relative lateral movement between the curved surface and the traversing arrangement for establishing the locii as a parallel pattern along which the marker head is movable and a drive arrangement is actuable for driving the traversing arrangement to effect the movement of the marker head. A control actuates the drive arrangement and the indexing arrangement to effect movement of the marker head along the parallel pattern of the locii and is responsive to a data input for actuating the marking devices to form a complete dot defined character during movement of the marker head along one of the locii.

Another feature of the invention provides a method for marking dot matrix characters upon a curved surface of a component having a given axis which comprises the steps of: providing a marker head having an array of marking devices supported thereon and disposed linearly from a first one thereof to the last thereof along a marker head axis and each selectively actuable to form a dot pixel of a dot matrix defined character;

orienting the marker head such that the marker head axis is skewed with respect to the given axis to an extent establishing a dimension of a said character corresponding with the widthwise spacing between the first and last marking devices;

moving the marker head along a first locus of marking travel over the surface and in parallel with the given axis; and selectively actuating the marking devices in the course of the marker head movement along the first locus to form at least one complete first dot matrix defined character.

Another feature of the invention provides a system for marking a message formed of pixel defined characters upon the inside surface of a pipe having an outside surface and a given longitudinal axis and which is movable along a production path. The system includes a marker head having a marker axis and an array of marking devices, selectively actuable to form said pixel defined characters within a predetermined matrix of select dimensional extent. Traversing apparatus is provided for supporting the marker head and is drivable for moving the marker head over and at an operational elevation above the inside surface of the pipe along locii substantially parallel with the given longitudinal axis of the pipe. An indexing arrangement is actuable to effect relative lateral movement between the pipe inside surface and the traversing apparatus for establishing the locii as a parallel pattern along which the marker head is moved in lieu thereof. A drive arrangement is actuable for driving the traversing apparatus to effect the movement of the marker head and a control arrangement is provided for actuating the drive arrangement and the indexing arrangement effect movement of the marker head to along said parallel pattern of the locii and is responsive to a data input for selectively actuating the marking devices to form one of the pixel defined characters during movement of the marker head along one of the locii.

Other objects of the invention will, in part, be obvious and will, in part, appear hereinafter. The invention, accordingly, comprises the system, method, and apparatus possessing the construction, combination of elements, arrangement of parts, and steps which are exemplified in the following description.

For a fuller understanding of the nature and objects of the invention, reference should be had to the following detailed description taken in connection with the accompanying drawings.

BRIEF DESCRIPTION OF THE DRAWINGS

FIGS. 13A and 13B combine as labeled thereon to provide a data flow diagram showing the assembly of pipe parameter data for developing a message text.

DETAILED DESCRIPTION OF THE INVENTION

Figure 1:
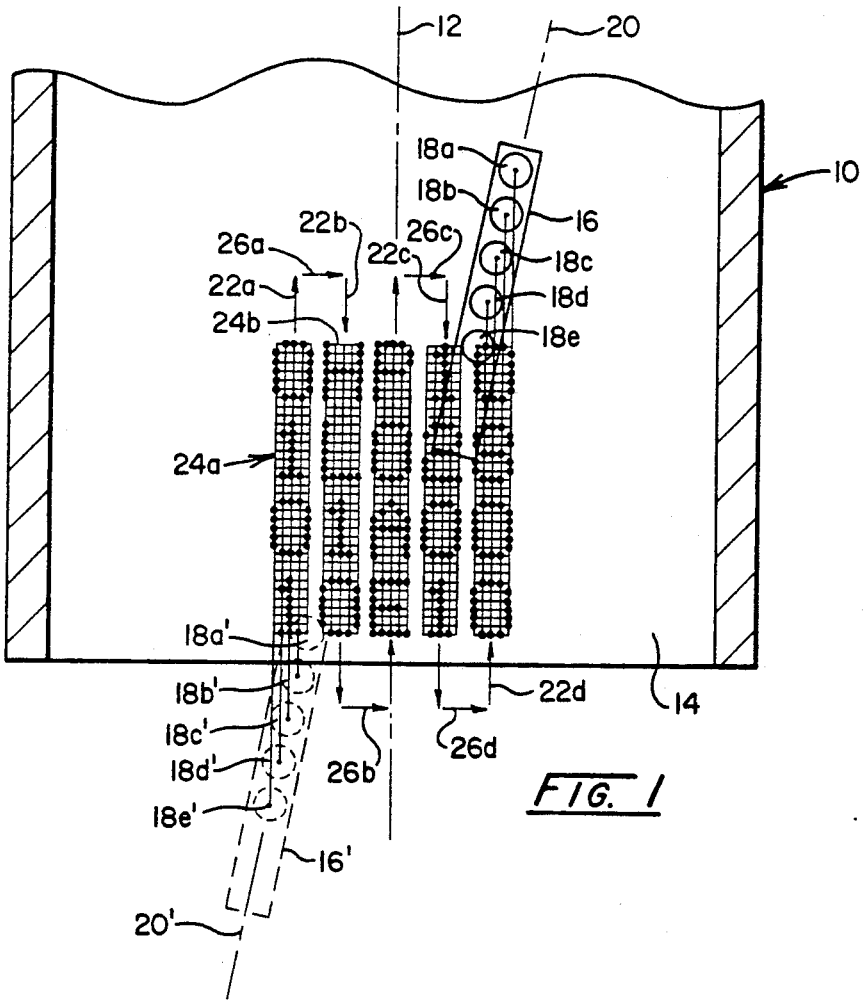
FIG. 1 is a schematic representation of the operation of a marker head in accordance with the invention, depicting a matrix pattern, representative characters, and relative movement.

The marking approach of the instant invention is one which achieves enhanced marking speeds at the internal surface of a pipe through the utilization of an array of marker components such as marker fluid nozzles, all of which combine in their operation to form a sequence of characters as the marker head within which they are mounted is moved along adjacent marking travel locii which are parallel with the central axis of the pipe. The result of this approach is an improvement not only in speed of marking and flexibility of treating systems wherein marking is carried out, but also a desirable simplification of machinery design is achieved. In FIG. 1, a diagrammatic representation of this technique is revealed. Referring to that figure, a pipe is represented generally at 10 having a central axis 12 and an internally disposed surface 14. Positioned within pipe 10 at a location representing a conclusion of internal marking movement is a fluid marker head 16 which is represented as having five active marking devices 18*a*–18*e*. These devices 18*a*–18*e* are seen to be disposed as a linear array positioned along the longitudinal axis 20 of marker head 16. Note that marker head axis 20 is skewed with respect to pipe axis 12 and this angulation serves to define the widthwise extent of the matrix within which the dot-like pixels defining characters are positioned. For the example shown, a 5×7 matrix is provided. Thus, for the type of movement imparted to marker head 16, five marker components are activated. Depending upon the character printed within this dot matrix format, each of the marking devices 18*a*–18*e* may participate in the formation of a given character.

Figure 12:
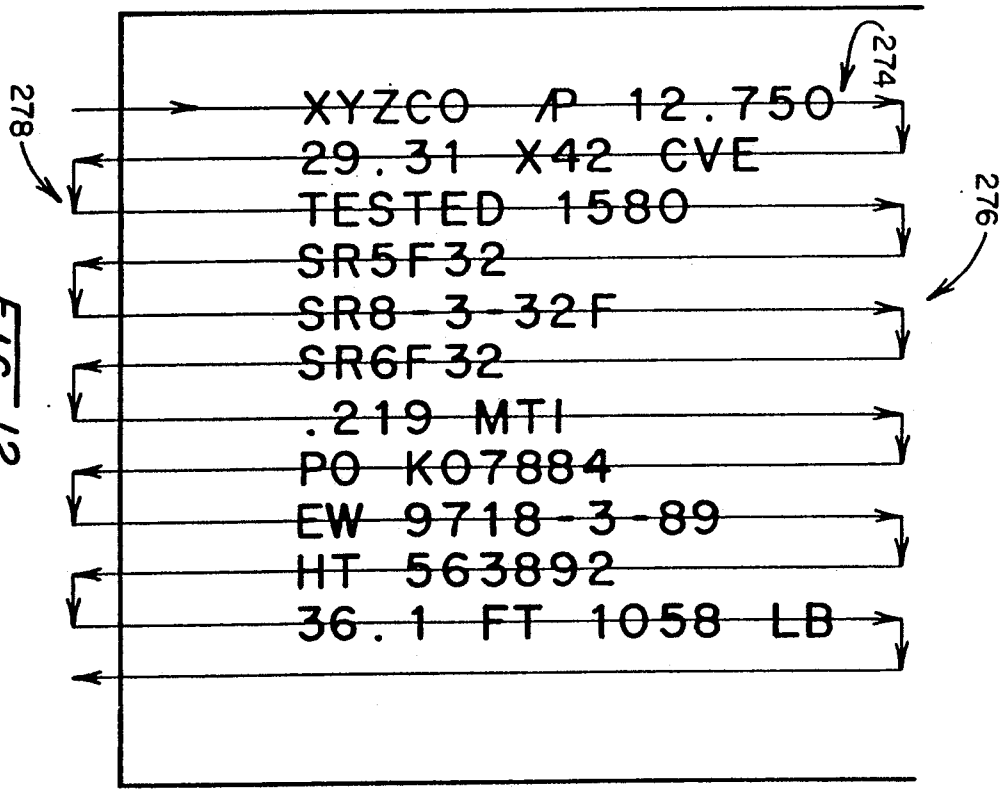
FIG. 12 is another diagrammatic representation of the internal surface of a pipe showing another message format and locus of travel for a marker head.

As will be observed later herein in conjunction with FIG. 12, where the characters are turned with respect to the arrangement of FIG. 1, seven marking devices will be employed.

The commencement of the marking procedure is illustrated in the figure in phantom, the marker head components being shown with the same numeration but in primed fashion. Note, that at the commencement of marking, the head as at 16' is moved inwardly into the pipe along a first locus 22a and as the head 16' is so moved, it defines the five columns of noted matrix, here shown in grid form at 24a. Commencing with the outside portion of the pipe, a sequence of characters 1, 0, 1, 0 are formed. As the head moves essentially to the innermost position, a relative motion occurs between the marker head 16 and pipe 10, such motion preferably occurring by the simple expedient of rotating pipe 10. This translational motion to a next locus 22b is represented by the arrow 26a. For the embodiment shown, the head 16 then is retracted along a next locus 22b to form a next line of characters within the matrix region 24b. It may be observed that this next locus of movement represets a "dry" path wherein the apparatus is not over or in contact with the earlier "printed" characters. As the head 16 reaches its retracted position, again a relative movement is carried out between pipe 10 and head 16 as represented by arrow 26b. This process continues until the full message is printed and, as is apparent, the message may extend around the entire internal surface of pipe 10. These ensuing locii of travel are represented, for example, at 22c and 22d and the translational movement progression is represented at 26c and 26d.

Figure 2:
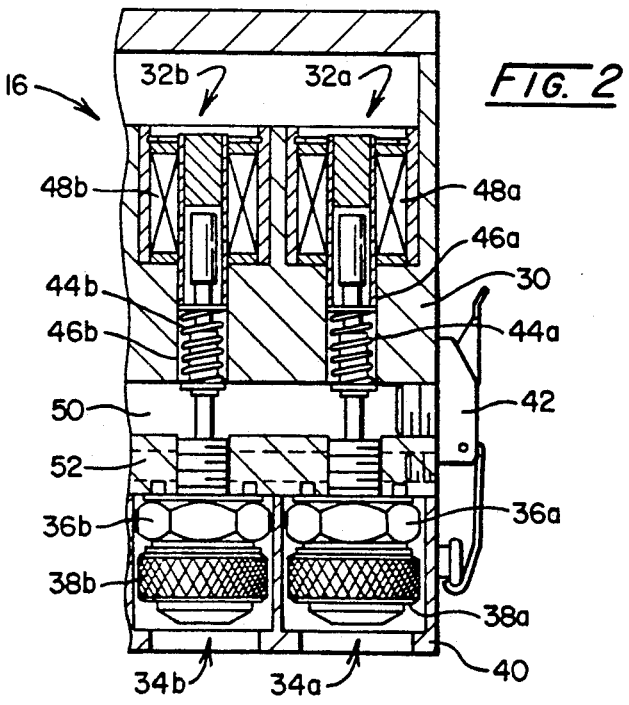
FIG. 2 is a partial sectional view of a marker head which may be employed with the invention.

A partial representation of a marker component 16 which may be employed with the invention is represented in FIG. 2. Described, for example, in a copending application for United States patent entitled "Marker Assembly for Spray Marking Dot Matrix, Characters and Method of Fabrication Thereof", by Cyphert, et al., Ser. No. 497,507, filed Mar. 22, 1990, and assigned in common herewith now U.S. Pat. No. 4,985,715, issued Jan. 15, 1991, head 16 is seen to include a body portion or housing 30 within which a linear array of channels, two of which are revealed at 32a and 32b, are formed. The identical marker components within the channels are described with the same identifying numeration but with the appropriate suffixes "a", or "b". Within each channel is a marker assembly which includes a two component nozzle as represented at 34a and 34b, the nozzle including a fluid cap as at 36a and 36b, and an associated air cap as at 38a and 38b. These nozzle assemblies 34a–34b are protected by an elongate nozzle guard, a portion of which is shown at 40. Guard 40 is removably retained in place by draw latches, one of which is revealed at 42. Within each channel as at 32a–32b there is positioned a valve stem-armature assembly as seen at 44a and 44b. These assemblies 44a–44b are spring biased forwardly to provide a closed valve position by helical springs as at 46a–46b and extend rearwardly to armatures which extend within the windings of solenoid assemblies as represented at 48a–48b. Marking fluid is supplied to the channels 32a–32b from an ink manifold duct 50, while air under pressure is supplied from a corresponding duct shown in phantom at 52. Thus, upon energization of the solenoid assemblies as at 48a–48b, the valve stem-armature assemblies are retracted to provide for the expression of marking fluid to create a dot-like pixel or character component.

In a typically encountered industrial setting, lengths of pipe will be observed to emerge from the fabrication arena to be presented sequentially in side-by-side or lateral orientation for presentation to a sequence of stations or the like which carry out a measurement of their length, a weighing of them, and a subsequent procedure marking the inside surfaces thereof. Typically, the latter procedures will be carried out as the pipe lengths are transferred to an in-line conveyor treatment wherein each is moved longitudinally or along its central axis in an indentifiable sequence which is tracked by in-plant control systems. Looking to FIG. 3, a length of pipe 60 is shown in broken-away fashion as it is positioned or fed onto an in-line, V-roll conveyor which includes conveyer rolls 62–65. A next adjacent pipe is shown in phantom at 66 awaiting placement upon the in-line conveyor system. The mechanism for feeding pipes as at 60 and 66 into the in-line conveyor system will take a variety of configurations, for example, one component of such a transfer mechanism being represented in general at 68. Looking additionally to FIG. 4, this mechanism 68 is revealed in greater detail. In figure, V-roll 63 is shown as being supported upon an axis 70 extending between bushings 72 and 74. Axle 70, in turn, is represented schematically as being driven by a motor represented at block 76. Thus, pipe 60, being placed upon a sequence of such rolls as at 64, will be maneuvered in line along a production path as represented by the arrow 78 in FIG. 3. To so position the pipe 60 upon rolls as at 64, the mechanism 68 is configured having an upstanding support as at 80 which is fixed to a base 82. Pivotally coupled to the upwardly disposed portion of support 80 is a transfer arm 84. Arm 84 is seen to be rotationally movable about pivot 86 and is configurated having an upwardly extending stop surface 88 which is seen to engage pipe 66 to retain it in a stand-by position awaiting transfer. The pipe 60 is seen to have rolled along the upward surface of arm 84 as at 90 until confronting a stop 92 at which position its central axis is aligned for positioning upon V-roll 63. Pivoting actuation of the arm 84 is, for example, by a hydraulic or air actuated piston-cylinder combination represented at 94. Thus, movement of the pipe 60 at the in-line orientation shown in FIG. 4 may be effected along the direction shown by arrow 78. Following the passage of pipe 60 along the in-line conveyor path, a positioning of next succeeding pipe 66 at the same location is carried out. This is accomplished by actuating device 94 to elevate the arm 84 to the position represented in phantom and in primed numeration. In such an orientation, the pipe 66 will roll by gravity onto the arm 84', whereupon, as before, device 94 is actuated to lower the arm, thus providing for the rolling of pipe 66 to the position earlier occupied by pipe 60. Further maneuvering of the arm 84 downwardly then functions, as before, to position the pipe upon V-rolls as at 63.

When within the in-line conveyor or production path, the pipes as at 60 may be measured for length, for example by contacting them with an encoder wheel and sensing the beginning edge and terminating edge of each pipe to compute length. Such systems are conventional and are not described herein. However, the transfer mechanisms involved with the system such as at 68 will be upstream in the process with respect to the features for measuring weight and marking discussed hereinafter. In addition to length measurement, the pipes as at 60 and 66 also may be weighed by in the in-line conveyor system. Such a weighing station is rerpresented in general at 100. Looking additionally to FIG. 56 the station 100 is seen to comprise a V-block 102 which is coupled, in turn, to a lower disposed air cylinder assembly 104 having a piston component 106 which functions to elevate block 102 and, in turn, lift the pipe engaged thereby slightly off of the in-line conveyor rollers as at 63. Cylinder assembly 104, in turn, is supported through base 108 upon one side of shear beam type load cells, two of which are revealed at 110 and 112. The opposite sides of cells 110 and 112 are, in turn, seen supported upon base 82. Following the derivation of a weighment with assembly 100, the cylinder assembly 104 functions to lower V-block 102 to again position the pipe as at 60 60 upon the V-rolls of the in-line conveyor system. The resultant weight data is transferred to the marking apparatus control system.

Returning to FIG. 3, pipe 60 is seen to have progressed in the direction of the in-line conveyor system as represented at arrow 78 until engaging or justifying against a disappearing stop represented at 120. Upon such engagement or justification, stop 120 lowers for permitting marker head access into the pipe 60. Stop 120 functions as part of a marking system represented in general at 122 which further includes an indexing apparatus represented in general at 124, a marking head (not shown) which is maneuvered in a marking motion represented by arrow 126 by a traversing mechanism represented at 128. Traversing mechanism 128 and the marking head associated therewith are maneuvered into the on-line orientation shown from a "home" or off-line orientation as represented in phantom at 128' by a lateral translating or transfer mechanism represented in general at 130. This motion between off-line and on-line positions is represented by the directional arrow 132.

Figures 6, 8:
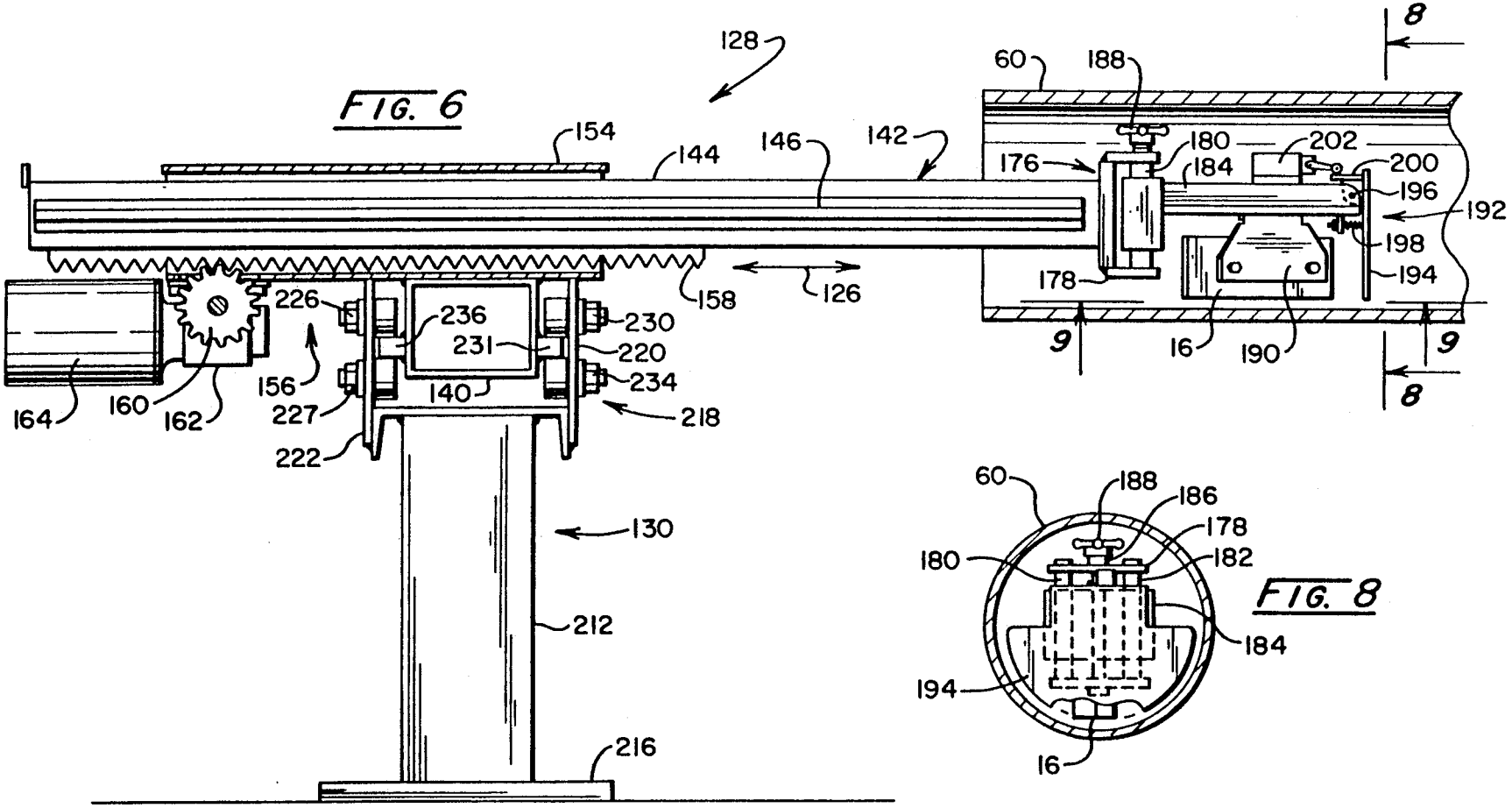
FIG. 6 is a partial sectional view taken through the plane 6—6 shown in FIG. 3.
FIG. 8 is a sectional view taken through the plane 8—8 shown in FIG. 6.
Figure 7:
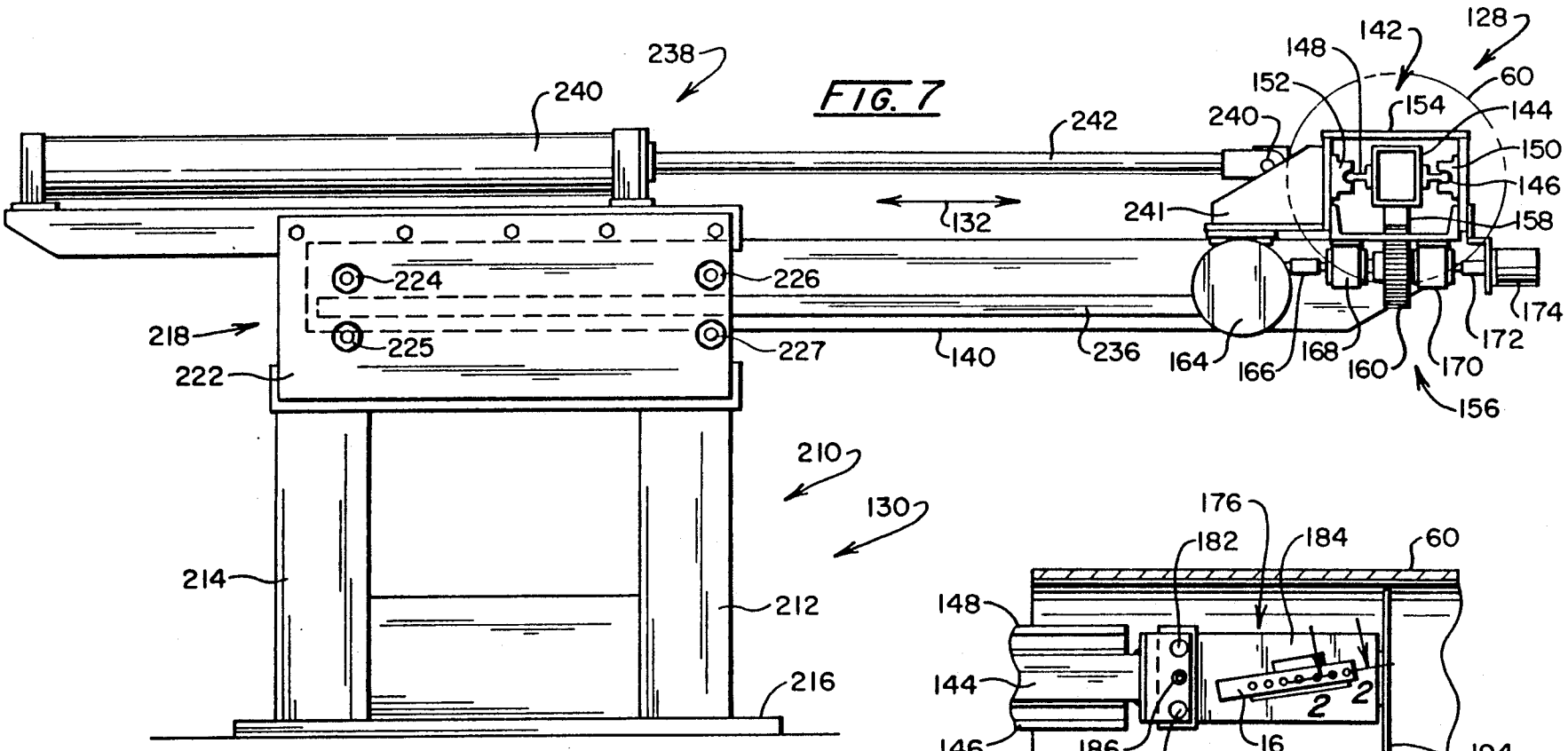
FIG. 7 is a front elevational view of the apparatus of FIG. 3.
Figure 9:
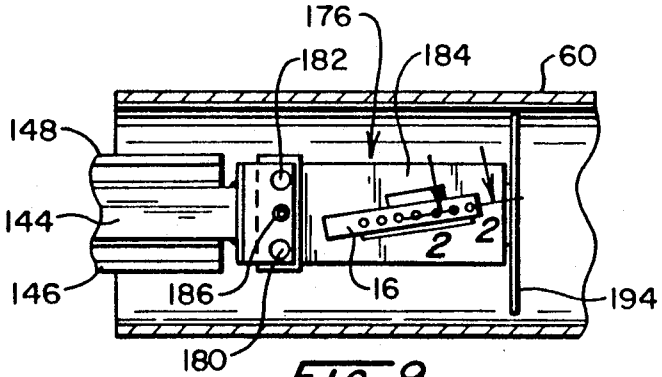
FIG. 9 is a sectional view taken through the plane 9—9 shown in FIG. 6.

Referring to FIG. 6, the traversing mechanism 128 is revealed in sectional fashion. In general, the mechanism 128 is supported by the extensible box beam 140 of lateral translating mechanism 130. Traversing mechanism 128 includes a carriage component 142 which is formed of a supporting box beam 144, the opposite sides of which are attached to elongate T-shaped rails, one of which is shown at 146 and each of which are seen in FIG. 7 at 146 and 148. FIG. 7 reveals that the rails 146 and 148 are slideably supported within respective ball bushings 150 and 152 which, in turn, are mounted to the sides of a box-shaped carriage housing 154. Reciprocating movement in the direction of arrow 126, which again is reproduced in FIG. 6, is imparted to the carriage component 142 by a rack and pinion assembly represented generally as 156. Assembly 156 includes a rack 158 mounted to the underside of beam or arm 144 and a pinion gear 160 which is driven from a right angle drive gear box 162, in turn driven by electric motor 164. For some applications, an air motor may be employed for this drive function. Looking to FIG. 7, the output of the gear box 162 (not shown) is connected through a coupler 166 to the axle or shaft (not shown) supporting pinion 160. In this regard, that shaft is rotationally supported within bearing blocks 168 and 170. A coupler 172 extends from connection with the pinion 160 supporting shaft to connection with an encoder 174 which tracks the instantaneous position of the carriage assembly 142.

Returning to FIG. 6, the carriage assembly 142 is shown to extend to a marker head mount represented generally at 176. Mount 176 includes a U-shaped bracket 178 which, as additionally seen in FIG. 8, includes two vertically oriented support rods 180 and 182. Slidably mounted upon these support rods and extending forwardly in cantilever fashion to a head mounting platform 184. The vertical elevation of platform 184 is established and is adjustable by virtue of its screws engaging connection with a jack screw 186. A manually adjusting handle 188 provides for this vertical maneuvering.

Platform 184 is seen in FIG. 6 to extend sufficiently outwardly to support an L-shaped bracket 190, which, in turn, supports the rectangular marker head 16. Bracket 190 is coupled to the platform 184 in a manner wherein it may be rotated or skewed to provide dimensional variation in the matrix within which characters are formed as described in connection with FIG. 1. To protect the head 16, a protective switch arrangement represented generally at 192 is positioned at the forward edge of platform 184. This arrangement 192 includes a trip plate 194 which is pivotally mounted to platform 184 at pivot 196 and which is biased into the vertical orientation shown by a threaded stud and compressible spring assembly 198. The switch tripping bracket 200 depends inwardly from the top of trip plate 194 and is seen to be engaged with the cam roller tip of a microswitch 202 mounted upon the top of platform 184. Thus, should the head mounting assembly 176 be driven towards an obstruction or the like, the trip plate 194 will be pushed inwardly to, in turn, actuate switch 202 for the purpose of developing a stop signal or the like which is responded to by the control system to cease or abort movement of the carriage assembly 142. Now considering the lateral translating mechanism 130 in detail, FIG. 7 reveals that the assembly includes a base 210 formed of two interconnected columns 212 and 214 which are, in turn, coupled to a floor mount plate 216. Base 218 supports a rectangularly shaped housing 218 which is seen in FIG. 6 to have two side plates 220 and 222, each of which, in turn, supports four roll members. In the latter regard, the four roll members attached to side 222 are represented at 224–227 in FIG. 7. Two of the four rolls similarly positioned in side 220 are shown in FIG. 6 at 230 and 231. The latter figure additionally shows slide rods 234 and 236 which are engaged by the rolls as at 224–227 and those such as 230 and 231 supported from side 220. The slide rods are, in turn, mounted to the sides of extensible box beam 140. Thus, the beam 140 is capable of movement between off-line and on-line positions as described in connection with arrow 132. To carry out this movement, an air cylinder assembly 238 if provided having a cylinder component 240 mounted to housing 218 and the extensible and retractable piston 242 of which is pivotally coupled at connector 243 to the beam 140 through a bracket assembly 241 as seen in FIG. 7.

Figure 3:
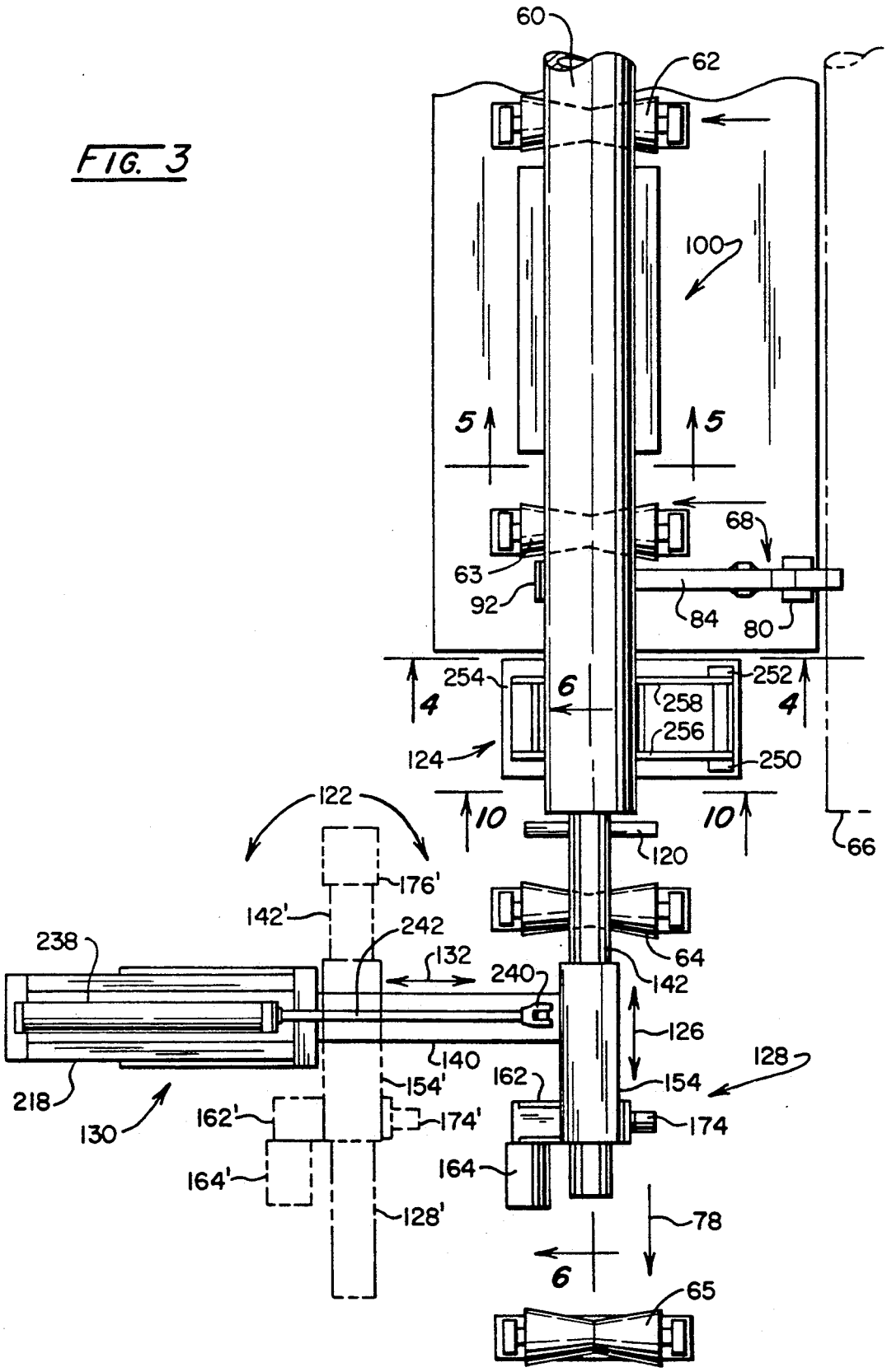
FIG. 3 is a partial top view of a pipe marking system according to the invention.
Figure 10:
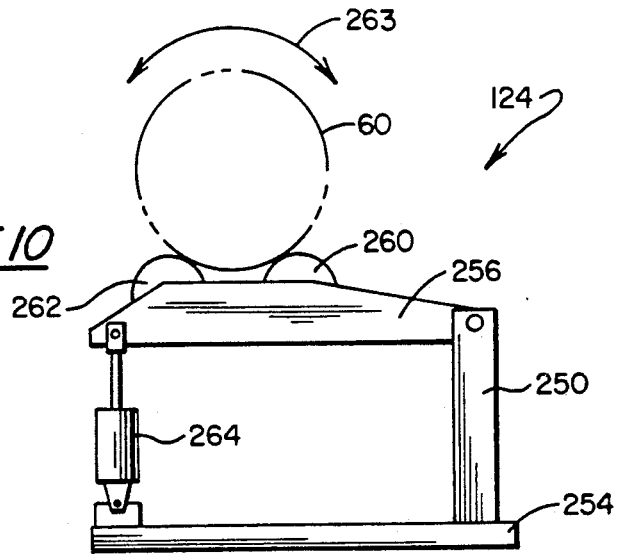
FIG. 10 is partial sectional view taken through the plane 10—10 shown in FIG. 3.
Figure 4:
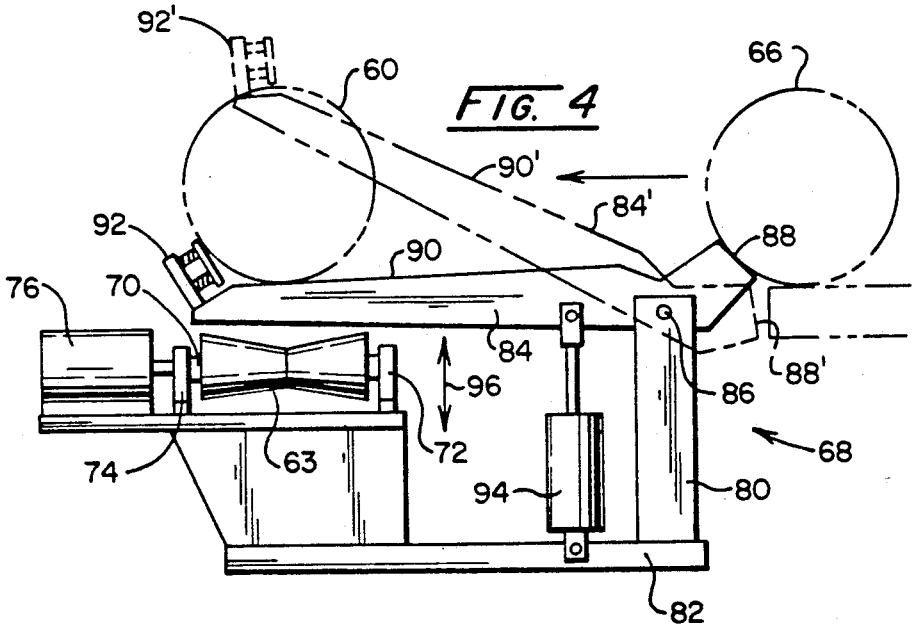
FIG. 4 is a partial sectional view taken through the plane 4—4 shown in FIG. 3.
Figure 5:
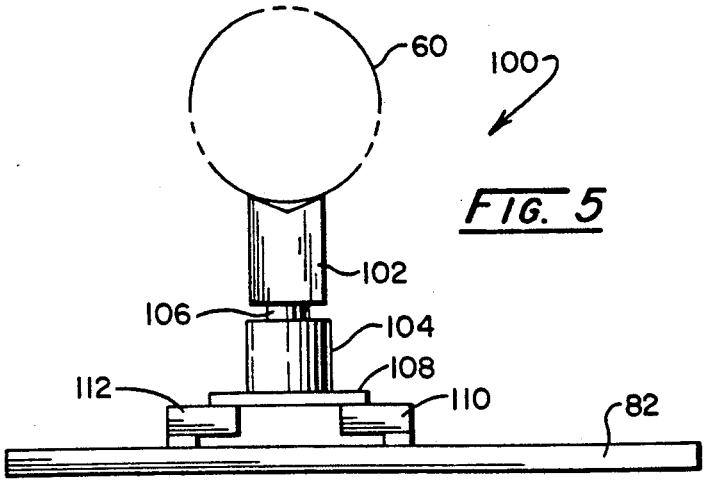
FIG. 5 is a partial sectional view taken through the plane 5—5 shown in FIG. 3.

With the arrangement shown, the air cylinder assembly 238 may be appropriately actuated to move the traversing mechanism 128 from the on-line position shown in FIG. 3 to an off-line orientation represented in phantom and with primed numeration in FIG. 3. To properly vertically support and carry out the rotational indexing movement of pipe 60, the earlier-noted support and indexing apparatus 124 is provided. Looking to FIGS. 3 and 10, the apparatus 124 is seen to include two upstanding columns 250 and 252 which are fixed to a base 254. Pivotally attached to the columns 250 and 252 are supporting arms shown, respectively, at 256 and 258. Arms 256 and 258, in turn, define a cradle for retaining pipe 60 which is configured having two rotationally mounted rolls, two of which are shown in FIG.

10 at 260 and 262. Select ones of these rolls are indexably drivable to rotate the pipe 60 as represented by arrow 263 in FIG. 10. To engage the pipe 60, the arms 256 and 258 are elevated by a centrally disposed hydraulic or air cylinder as represented at 264 in FIG. 10. Thus, as the pipe 60 moves in the in-line direction represented by arrow 78 in FIG. 3, it engages the disappearing stop and is justified with respect to its in-line position. Cylinder 264 then is actuated to effect the pipe's support and engagement by rolls such as at 260 and 262 and elevate it to a predetermined vertical orientation suited for permitting the entrance thereinto of the marker head and traversing mechanism 128. The latter marking motion is carried out following the maneuvering of the marking assembly from its off-line position to its on-line position by the lateral translating mechanism 130. Following marking, the traversing mechanism 128 withdraws from the pipe and the lateral translating mechanism 130 is actuated to move the marker head and translating mechanism to its off-line position. As noted above, disappearing stop 120 will have been lowered before the commencement o the marking procedure. Device 264 is actuated to lower arms 256 and 258 of apparatus 124. The pipe 60 then progresses along the in-line conveyor system as represented at arrow 78 in FIG. 3.

Figure 11:
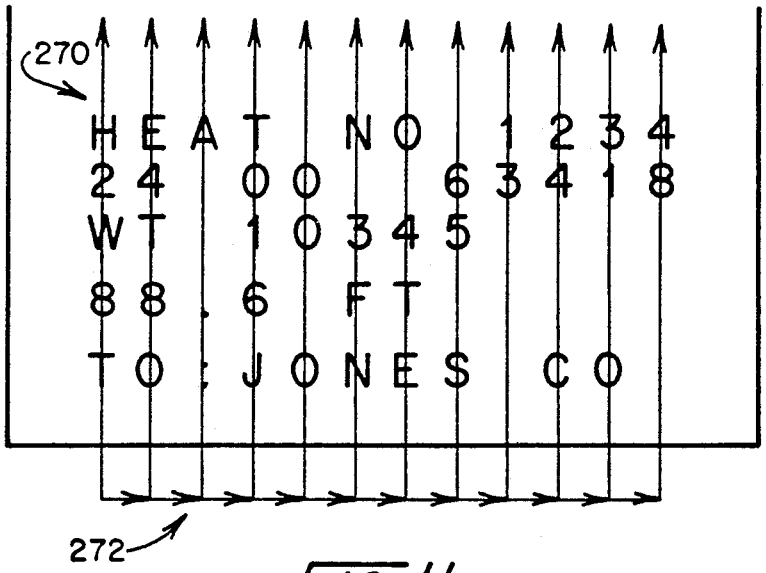
FIG. 11 is a diagrammatic representation of a pipe internal surface showing a representative message and a locus of travel for a marker head according to the invention.

The marking arrangement of the invention is capable of marking with differing orientations of the information required. A desirable arrangement is that represented in FIG. 11 wherein the data which are marked are provided in a "tiered" manner. Preferably, to achieve uniformity of character placement for each row or tier of information, the actuation of the marker components of the marker head is made consistently in the same direction as represented by the locii arrows represented generally at 270. As before, the indexing rotation of the pipe is represented by the small arrows shown generally at 272. By marking only during movement in a unidirectional manner, mechanical "play" phenomena or looseness occasioned, for example, by the wearing of limit switches, mechanisms and the like, tend to repeat such that character alignment remains proper even though mechanical wear conditions occur. Another writing or marking technique is represented in FIG. 12 wherein an undulating or alternately reversing locus of movement is carried out as represented generally by the arrows 274. In this embodiment, for example, all seven of the available marker components within the head 16 are activated to provide a $5\times7$ matrix structuring of the characters formed. As before, the indexing rotational movement of the pipe is represented generally by the horizontal arrows as shown at 276 and 278. The marking during reciprocating movement of the marker head 16 is available with the arrangement of FIG. 12 inasmuch as the vertical alignment of characters is not a critical feature of the message provided.

Figure 13A:
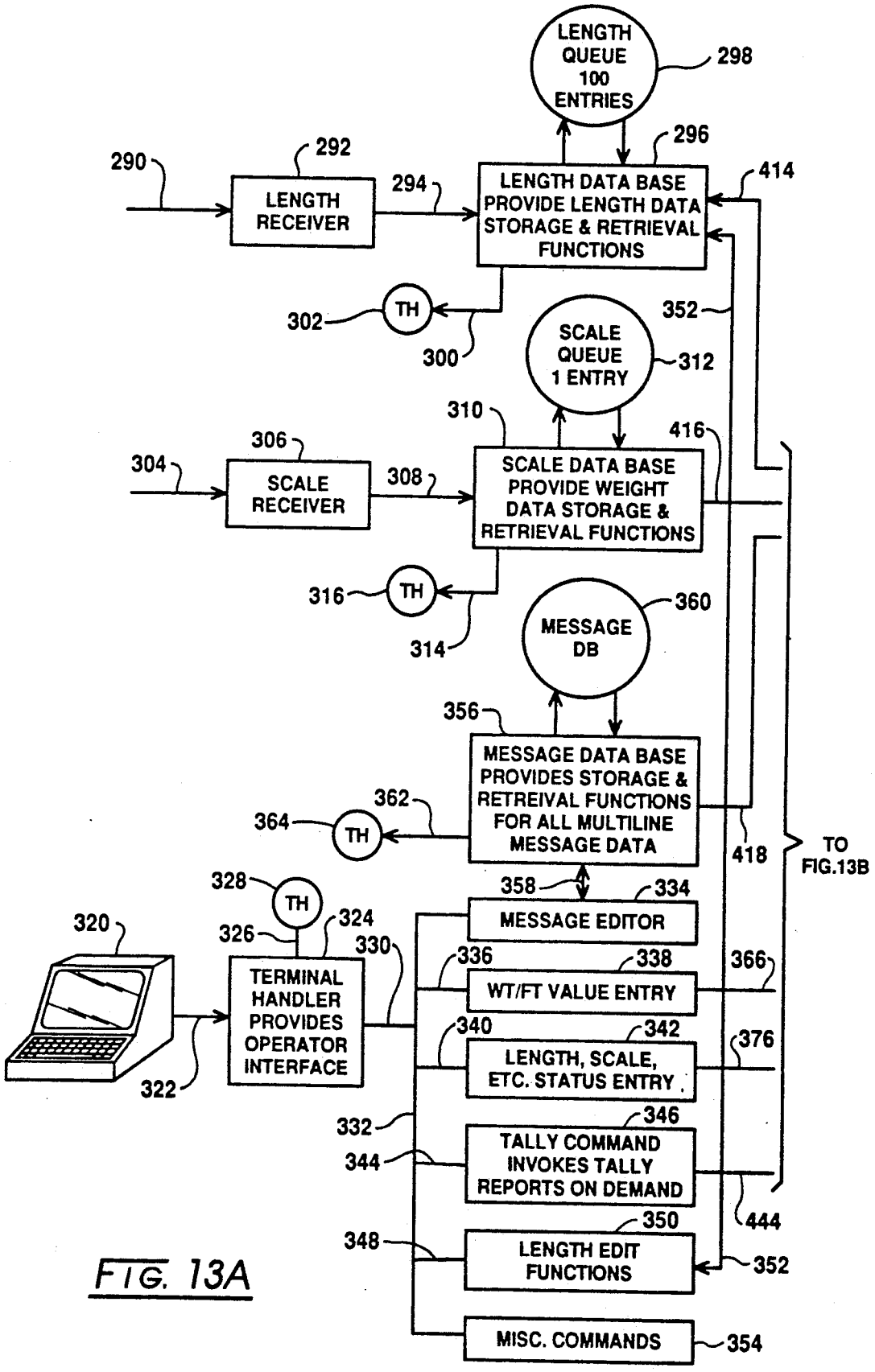

Referring to FIGS. 13A and 13B, a data flow diagram is presented representing the computer based control features of the invention. In FIG. 13A, serial pipe length data from a length measuring system is introduced, for example, via an RS232 connection as is represented at line 290. These data are directed to a length receiver function represented at 292 which is an interrupt task serving to handle character reception. The length data then progresses as represented at line 294 and block 296 to introduction to a length database which provides length data storage and retrieval functions. The length database as represented at block 296 is associated with a memory for queueing length entries associated with a sequence pipes. This latter memory is represented at symbol 298. The length data also are directed to a terminal handler as represented at line 300 and node 302.

Serial weight data as introduced to the system are represented at line 304. These data are derived from the weighing apparatus as described generally at 100 above. The serialized data are directed to a scale receiver function represented at block 306 which, as before, is an interrupt task which handles character reception. The weight data thus treated are directed as represented at line 308 to a scale database as represented at block 310. This function carries out the storage of weight data and provides a retrieval function. The storage aspect of this function at block 310 is represented at symbol 312 showing that there is a queueing of weight data for successive pipes. As before, as represented at line 314 and node 316, the same information is made available to a terminal handler function.

With respect to the latter function, an operator terminal interface is represented at symbol 320 as providing interactive communication as represented at line 322 with the terminal handler function as represented at block 324. This function carries out the display of information, for example, as derived with respect to pipe length and described in connection with line 300 and node 302 and with corresponding pipe weight as described in connection with line 314 and node 316. The terminal handler function as represented at line 326 and node 328 serves to provide display where called for of such data at the terminal 320. Operator commands from the keyboard of terminal 320 also are handled by the terminal handler function. The latter function as represented at line 330 and block 334 also provides a message editor function which is in the nature of a word processing function permitting the operator to generate, edit, and maneuver text materials. Line 336 and block 338 show another handler function permitting the operator to enter weight per foot values into the system. Similarly, length scale and status data can be entered by the operator as represented at line 340 and block 342, while tallies or compilations providing on-going reports or data are available for entry as represented by line 344 and block 346. Tally information, for example, may include total accumulated pipe weight, numbers of rejects, and the like. The length editing function represented at line 348 and block 350 permits the operator to adjust total length values where pipe components may be removed by cranes from the queueing thereof or the like. Interactive data in this regard is submitted to the length database as represented at block 296 as indicated by line 352. Finally, miscellaneous commands may be developed by the operator as represented at block 354.

The message editor command handler as represented at block 334 provides for interactive communication with a message database as represented at block 356 and line 358. The message database performs in conjuction with memory as represented at symbol 360 and, as before, provides for terminal handler input or display to the terminal 320 as represented at line 362 and node 364.

As represented at line 366 extending from the weight per foot value entry task at block 338, new variable data may be directed to a variables database as represented at block 368. This function at block 368 provides for storage, as represented at symbol 370, of variable data in the nature of numbers which vary during the course of production. The information of this variable nature also is directed to display as represented by line 372 and terminal handler node 374.

Looking additionally to FIG. 13B, the length, scale, and status information as described in connection with handler function 342 is in communication as new status data for the system with a status database represented at block 378. The memory component of this status database is represented at symbol 380. System status information is involved with this database, for example information as to whether the length measuring system is on-line or off-line. Such status information also is displayable to the operator at terminal 320 as represented by line 382 and terminal handler node 384.

An input/output scan function is represented at block 386. This is a routine that constantly polls or scans input messages and, additionally, passes on information to later stages of the overall pipe fabricating process. In this regard, as represented at line 388, cycle start information is scanned. The abort information at line 390 either can be generated by an operator input or, for example, by switching functions such as that described in FIG. 6 at 202. A prime pipe input as represented at line 392 is an operator-generated signal indicating that pipe is good. Similarly, where an operator inspection indicates that a pipe has failed an inspection test, then a signal as represented at line 394 will be received. Where a tolerance error is determined by the program as at block 386, for example based upon length and weight inputs as compared with desired weight per length, then such an error is publishable to later stages in the production process. Similarly, based upon the above inputs, a pass or fail signal may be generated by the program at block 386 for distribution to downsteam conveyor equipment.

As represented at line 410, the I/O scanning program as represented at block 386 also provides a command for formatting information to be printed upon the inside surface of a pipe. In effect, this command indicates that a pipe is now ready for marking. The formatting program as represented at block 412 responds by interrogating other data collecting functions. In this regard, as represented at line 414, the length databse as represented at block 296 is accessed for the length of the pipe ready for marking. Similarly, as represented at line 416, weight data are obtained from the weighing program as represented at block 310. Additionally, as represented at line 418, the message information from the message database as at block 356 is accessed. Variables are accessed as represented at line 420 extending to the variables database as represented at block 368 and statisties with respect to length, weight, and the like are accessed from the status database as represented at block 378 an line 422. All of the above information, when formatted, additionally is made accessible to the operator at terminal 320 through the terminal handler routine as represented at line 424 and node 426.

The formatted information concerned with length and weight data evolved in conjunction with the program represented by block 412 is directed, as represented by line 428 to a tally database as represented at block 430. The database which is associated with the memory is represented at symbol 432. This database stores data from a pipe upon completion of measurement and weighting and the like for compilation purpose and production reports. Accordingly, data which are developed on a pipe-by-pipe basis are directed as represented by line 434 and block 436 to the generation of a production report which is carried out on a pipe-by-pipe basis. The report text evolved from the function at block 436 is directed, as report text as represented at line 438 to a printer driver represented at block 440. In conventional fashion, the output of printer driver 440 as represented at line 442 serves to provide a signal input to a printer, for example, through an RS232 connection.

Where an operator issues a tally command, for example as described in connection with block 346 in FIG. 13A, that command, as represented at line 444 activates routines bringing together a tally report as represented at block 446. In compiling this report, the program as represented at block 446 interactively communicates with the tally database represented at block 430 as indicated by line 448. The resultant report text information then, as represented at line 450, is directed to the earlier-noted printer driver program as represented at block 440. Printing then occurs by signal outputs as represented at line 442.

After the format routine as described in conjunction with block 412 assembles all the data and generates the text which is to be printed on the inside surface of the pipe. As represented by line 452 and block 454, that data as present as formatted text are then directed to an extended protocol driver which formats the information such that it is suitable for presentation to the control system of the marker apparatus. The thus-formatted information then is directed to that marker system as represented at line 456.

Figure 14A:
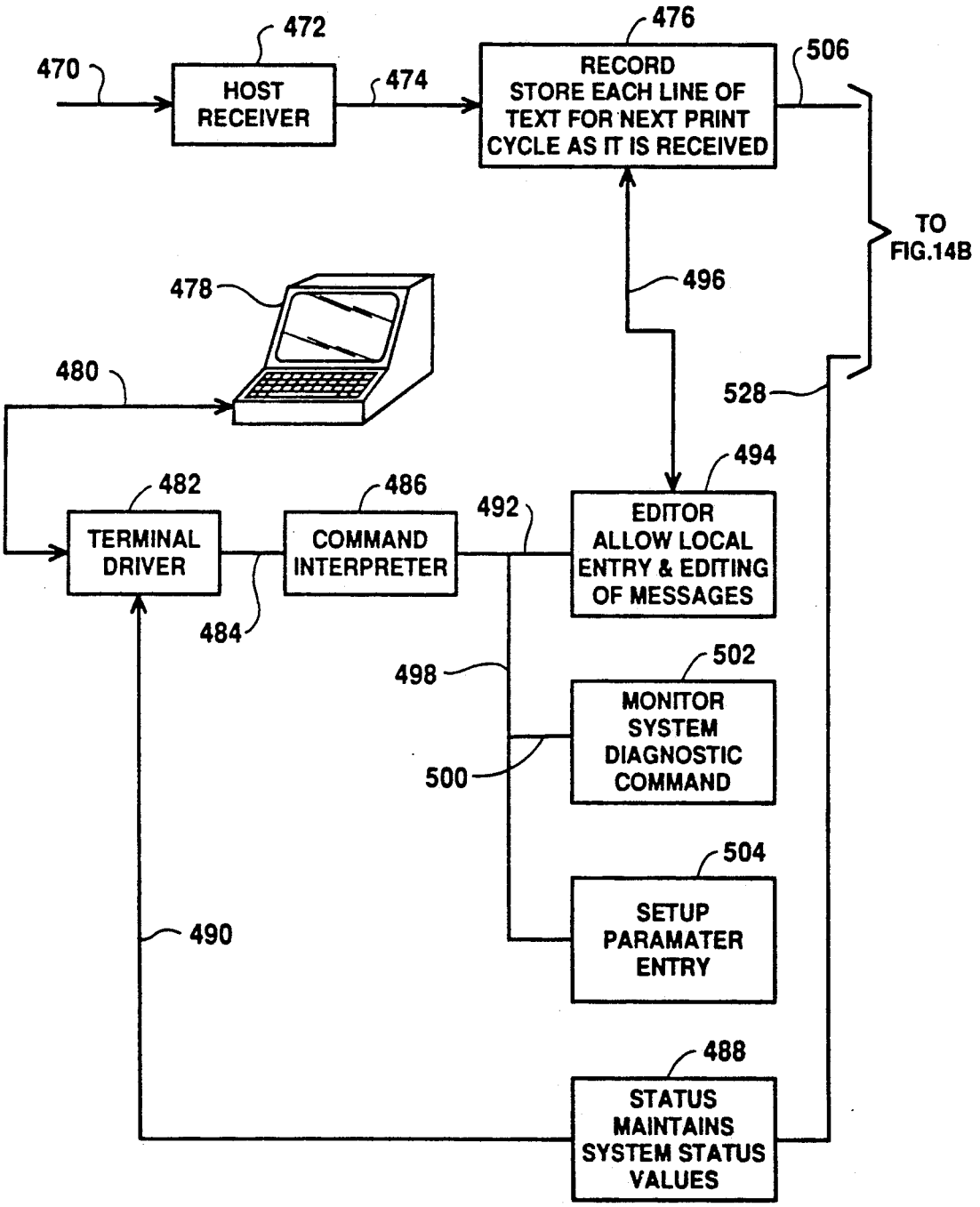
FIGS. 14A and 14B combine as labeled thereon to show a data flow diagram for developing a message text and deriving marker head actuation in accordance therewith.
Figure 14B:
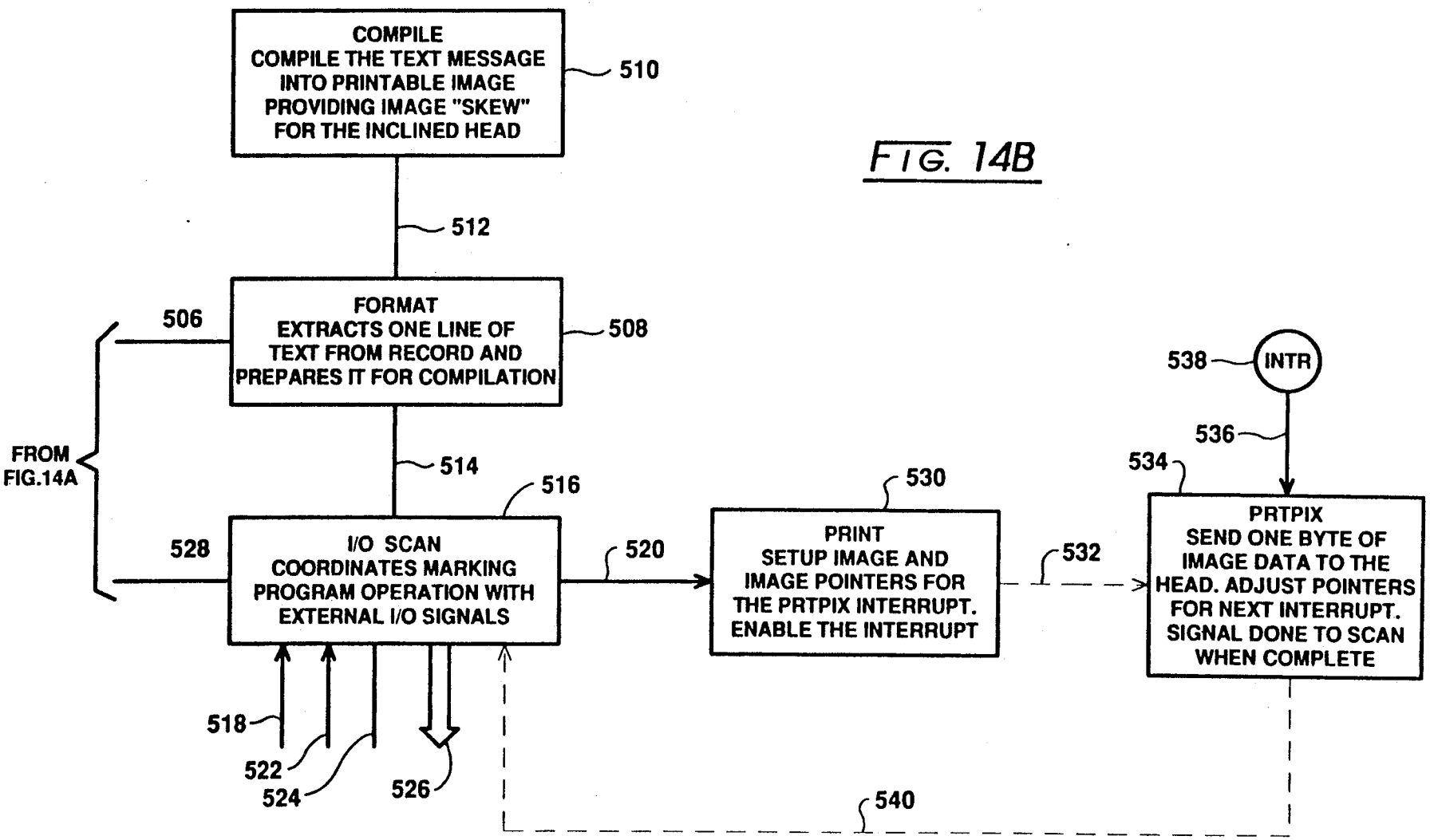

Referring to FIGS. 14A and 14B, a data flow diagram is provided illustrating the operation of the control features of the marker function. In FIG. 14A, data as developed, for example, by the extended protocol driver 454 described in conjunction with FIG. 13B are entered into the system as represented at line 470. These data are received by a host receiver program represented at block 472 much in the manner of the receiver functions described earlier in conjuction with FIG. 13A at block 292 and 306. Message text is transferred from this host receiver function as represented at line 474 to a record of program at block 476. The record essentially is similar to a database and stores a message for ultimate printing.

Operator interaction for the instant function is provided from, for example, a terminal as represented at symbol 478. Interactive communication between the terminal and a terminal driver is represented by line 480 and block 482. Terminal driver 482 performs in conjunction with a command interpreter as represented at line 484 and block 486. Similar to the earlier-described terminal handling function, the command interpreter receives the commands of the operator and enters and interprets them through the execution of appropriate commands. The terminal driver also is seen to receive status information as represented by the status monitoring function represented at block 488 and line 490. Thus, the status of the system components at hand can be displayed at the terminal 478.

The command interpreter function also performs in conjunction with an editing function as represented at line 492 and block 494. As seen at line 496, an interactive relationship exists between the editor function and the record such that message can be retrieved for editing on the part of the operator at the terminal 478 and then placed back in the record represented at block 476. Additionally associated with the command interpreter 486 as represented by lines 498 and 500 is a monitor command function as represented at block 502 which provides for the execution of system diagnostics of the marking system to test out its functionality. Similarly, line 498 extends to the function represented at block 504 wherein parameters are entered by the operator at the set-up of the system. These parameters will involve such conditions as the timing of solenoid actuators within the marker head valving and the like.

Looking additionally to FIG. 14B, message text is retrieved from the record or database 476 as represented at line 506 by a format function which carries out the necessary procedures for making the text ready for printing. The format function at block 508 works in concert with a compiling function represented at block 510, the association therebetween being represented at line 512. The compiler operation as represented at block 510 takes the ASCII text and converts it or generates a bit map image therefrom serving the purpose of selectively driving the solenoids of the marker components. The bit map image, for example, achieves such characteristics as the character lean for the inclined head 16.

In general, the format operation is interactive with the input/output or I/O scan function as represented by line 514 and block 516. The latter scan function, for example, may have received a start print command from system control as represented at line 518 whereupon it calls the format function at block 508 for a compiled image. The format function 508 compiles the image as noted above and returns it to the I/O scan function as represented at block 516. The scan function then sends the compiled image and a print command as represented at line 520. Generally, the start print command is received from the overall control of the system and will have been received at such time as the pipe is at an appropriate stop and is indexed properly and ready for printing. Movement of the head support apparatus generally will be underway at this point in time. The direction command as represented at line 522 provides information as to which movement direction is at hand for the printing procedure. The abort command as represented at line 524 serves to stop the procedure in the event of an interference signal, for example from switch 202, an operator intervention or the like. Output arrow 526 supplies three output functions including information that a message is at hand or ready; information that a line of printing is under way; or that the printing function is completed. Status data as so coordinated by the scan function 516 are made available to the operator display at terminal 478 as represented by line 528 leading to the status function as represented at block 488 in FIG. 14A.

The print command and compiled image then is set-up and image pointers are set for the PRTPIX interrupt routine. The interrupt function also is enabled as represented at block 530 and as shown at dotted lin 532 and block 534, the PRTRIX routine serves to send one byte of image data to the head driving function and an adjustment for a next interrupt is made. The interrupt signal is that initially generate by the encoder 174 (FIGS. 3, 7) which represents a given number of pulses per distance of carriage movement. This information representing head position is divided such that an interrupt is developed as represented at line 536 and node 538 which occurs at the appropriate time for the position of a given pixel in the character matrix. Where the image data shows that a dot should be formed, then the system commands the formation of that dot and, as noted, pointer adjustment then is carried out. At the completion of a message, a global variable representing printing complete or "DONE PRINTING" is generated and directed, as represented by dashed line 540 to the scan function 516.

Since certain changes may be made in the above system, apparatus, and method without departing from the scope of the invention herein involved, it is intended that all matter contained in the above description or shown in the accompanying drawing shall be interperted as illustrative and not in a limiting sense.

I claim:

1. Apparatus for marking dot matrix characters upon a curved surface of a component having a given axis about which said surface is curved, comprising:

support means for locating said curved surface at a marking station;

a marker head having a marker axis and a linear array of marking devices, each selectively actuable to form dot pixels of a pixel defined character within a predetermined matrix of select dimensional extent;

traversing means for supporting said marker head at an elevation above said surface to position said array of marking devices for marking interaction therewith, and being drivable for reciprocally moving said marker head along locii substantially parallel with said given axis;

indexing means actuable to effect relative lateral movement between said curved surface and said traversing means for establishing said locii as a parallel pattern along which said marker head is movable;

drive means actuable for driving said traversing means to effect said movement of said marker head; and control means for actuating said drive means and said indexing means to effect movement of said marker head along said parallel pattern of said locii, and responsive to a data input for actuating said marking devices to form a complete said pixel defined character during said movement of said marker head along one of said locii.

2. The apparatus of claim 1 in which said marker axis is skewed with respect to said given axis an amount selected to provide said select dimensional extent of said predetermined matrix.

3. The apparatus of claim 1 in which said marking devices are spray markers electrically actuable to express a marker fluid toward said surface.

4. The apparatus of claim 1 in which said indexing means is actuable to effect said relative lateral movement between said curved surface and said traversing means by effecting an indexing rotational movement of said curved surface about said given axis.

5. The apparatus of claim 4 in which:

said support means comprises:

a cradle positioned beneath said curved surface; and actuator means for elevating said cradle to effect supporting engagement with said component; and said indexing means comprises:

first and second rotatable component supports mounted upon said cradle for effecting said engagement, rotator means actuable for effecting a select driven rotation of one of said first and second rotatable component support; and said control means actuation of said indexing means includes actuation of said actuator means and said rotator means.

6. The apparatus of claim 1 in which said traversing means includes:

a carriage assembly having a head mounting portion for supporting said marker above said curved surface and reciprocally drivably movable along a linear path defining said locii; and vertical position adjustment means actuable for vertically locating said marker head a predetermined distance above said curved surface.

7. The apparatus of claim 6 in which said drive means includes a rack and pinion assembly, the rack of which is coupled with said carriage assembly.

8. The apparatus of claim 1 in which said traversing means includes:

protective switch means mounted thereon forwardly of said marker head and having a trip plate extending before said array of marking devices and deflectable upon contact with an obstruction thereto to derive a stop signal; and said control means is responsive to said stop signal for terminating the actuation of said drive means.

9. A method for marking dot matrix characters upon a curved surface of a component having a given axis comprising the steps of:

providing a marker head having an array of marking devices supported thereon and disposed linearly from a first one thereof to a last thereof along a marker head axis and each selectively actuable to form a dot pixel of a dot matrix defined character;

orienting said marker head such that said marker head axis is skewed with respect to said given axis to an extent establishing a dimension of said dot matrix defined character corresponding with a widthwise spacing between said first and last marking devices;

moving said marker head along a first locus of marking travel over said surface and in parallel with said given axis; and selectively actuating said marking devices during marker head movement along said first locus to form at least one complete first said dot matrix defined character.

10. The method of claim 9 including the steps of :

effecting relative indexing movement between said marker head and said surface upon completion of said movement along said first locus to a next adjacent marking position;

moving said marker head along a next locus of marking travel parallel with said given axis including said next adjacent marking position; and selectively actuating said marking devices during said marker head movement along said next locus to form at least one complete second said dot matrix defined character.

11. The method of claim 10 in which said relative indexing movement is carried out by effecting rotational movement of said curved surface about said given axis.

12. The method of claim 10 in which said select actuation of said marking devices during said marker head movement along said first locus and said next locus generates two adjacent, in-line characters visually readable in a left-to-right sense.

13. The method of claim 12 in which said marker head movement along said next locus of marking travel is in a same direction as said marker head movement along said first locus of travel.

14. The method of claim 9 in which said marker devices are provided as marker fluid spray printers.

15. The method of claim 10 in which said movement of said marker head along said next locus of marking travel is opposite to said movement thereof along said first locus.

16. A system for marking a message formed of pixel defined characters upon an inside surface of a pipe having an outside surface and a given longitudinal axis and movable along a production path, comprising:

a marker head having a marker axis and an array of marking devices, selectively actuable to form said pixel defined characters within a predetermined matrix of select dimensional extent;

traversing apparatus for supporting said marker head and drivable for moving said marker head over and at an operational elevation above said inside surface along locii substantially parallel with said given longitudinal axis;

indexing means actuable to effect relative lateral movement between said pipe inside surface and said traversing apparatus for establishing said locii as a parallel pattern along which said marker head is movable;

drive means actuable for driving said traversing apparatus to effect said movement of said marker head; and control means for actuating said drive means and said indexing means to effect movement of said marker head along said parallel pattern of said locii and responsive to data input for selectively actuating said marking devices to form one of said pixel defined characters during said movement of said marker head along one of said locii.

17. The system of claim 16 in which said marker head array of marking devices is linear and said marking devices thereof are positioned along said marker axis; and said marker axis is skewed with respect to said given axis an amount selected to provide said pixel defined characters within said predetermined matrix of select dimensional extent 18. The system of claim 16 in which said indexing means is actuable to effect said relative lateral movement between said inside surface and said traversing apparatus by effecting a rotational movement of said pipe about said given longitudinal axis.

19. The system of claim 18 in which said indexing means is positioned within said production path and comprises:

a pipe supporting cradle movable between retracted and elevated orientations; and roll means supported by said cradle, engageable with said pipe outside surface when said cradle is moved to said elevated orientation; and actuable by control means to effect an indexing rotation movement.

20. The system of claim 16 in which said traversing apparatus includes:

a carriage assembly having a head mounting portion for supporting said marker head and drivable by said drive means for movement of said marker head into and out of said pipe over said inside surface along a linear path defining said locii; and vertical position adjustment means actuable for vertically locating said marker head a predetermined distance above said inside surface.

21. The system of claim 20 in which:

said traversing means includes transfer mechanism means actuable for moving said carriage assembly from an off-line position out of said production path to an on-line position located for effecting said carriage assembly drive; and said control means is responsive to activate said transfer mechanism means from said off-line position to said on-line position when said pipe is adjacent a select location within said production path.

22. The system of claim 20 in which said drive means includes a rack and pinion assembly, the rack of which is coupled with said carriage assembly.

23. The system of claim 16 including:

weighing station means positioned within said production path for weighing said pipe to derive a weight signal; and said control means is responsive to said weight signal as said data input.

24. The system of claim 16 in which said traversing apparatus includes:

protective switch means mounted thereon forwardly of said marker head and having a trip plate extending before said array of marking devices and deflectable upon said contact with an obstruction thereto to derive a stop signal; and said control means is responsive to said stop signal for terminating said drive means driving of said traversing apparatus.

25. The system of claim 16 in which said control means is responsive to said data inputs for actuating said marking devices during said marker head movement along a first one of said locii and, thence, along a next adjacent one of said locii to generate two, adjacent, in-line characters visually readable in a left-to right sense.

26. the system of claim 25 in which said marker head movement along said next adjacent one of said locii is in a same direction as said marker head movement along said first one of said locii.

* * * * *